US007599644B2

(12) United States Patent
Kawata

(10) Patent No.: US 7,599,644 B2
(45) Date of Patent: Oct. 6, 2009

(54) PROCESS CARTRIDGE AND IMAGE FORMING APPARATUS THAT ELIMINATES CHARGE FROM THE SURFACE OF A PHOTOSENSITIVE MEMBER UPSTREAM OF A SEALING MEMBER CONTACT PORTION

(75) Inventor: Kentarou Kawata, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 492 days.

(21) Appl. No.: 11/535,763

(22) Filed: Sep. 27, 2006

(65) Prior Publication Data

US 2008/0075500 A1 Mar. 27, 2008

(51) Int. Cl.
*G03G 15/00* (2006.01)
*G03G 21/00* (2006.01)
*G03G 21/18* (2006.01)

(52) U.S. Cl. ..... 399/102; 399/111; 399/159; 399/350

(58) Field of Classification Search ..... 399/102, 399/129, 159, 350, 351, 111
See application file for complete search history.

(56) References Cited

U.S. PATENT DOCUMENTS

| | | | | |
|---|---|---|---|---|
| 4,561,766 | A * | 12/1985 | Fox | 399/102 |
| 5,991,568 | A * | 11/1999 | Ziegelmuller et al. | 399/102 |
| 6,819,899 | B2 * | 11/2004 | Miyakawa et al. | 399/252 |
| 7,027,758 | B2 * | 4/2006 | Miyakawa et al. | 399/159 |
| 2005/0220464 | A1 | 10/2005 | Kobayashi et al. | 399/27 |
| 2006/0188292 | A1 | 8/2006 | Matsuda et al. | 399/174 |

FOREIGN PATENT DOCUMENTS

| | | |
|---|---|---|
| JP | 1-21323 | 6/1989 |
| JP | 2000-227668 | 8/2000 |

* cited by examiner

*Primary Examiner*—William J Royer
(74) *Attorney, Agent, or Firm*—Fitzpatrick, Cella, Harper & Scinto

(57) ABSTRACT

An image forming apparatus suppresses the deposition of transfer-residual toner on a sealing sheet and also suppresses the dropping of deposited toner therefrom, at a high temperature and in a high humidity environment. The apparatus includes a photosensitive drum, a cleaning blade for removing toner, a housing portion for housing the toner removed by the cleaning blade, and a sealing sheet for preventing the leakage of toner and performs charge elimination upstream of the sealing sheet in the direction of movement of the photosensitive drum, wherein a work function difference between the sealing sheet and the photosensitive drum is equal to or greater than 0.25 eV.

10 Claims, 10 Drawing Sheets

PROCESS CARTRIDGE AND IMAGE FORMING APPARATUS THAT ELIMINATES CHARGE FROM THE SURFACE OF A PHOTOSENSITIVE MEMBER UPSTREAM OF A SEALING MEMBER CONTACT PORTION

TECHNICAL FIELD

The present invention relates to a process cartridge and an image forming apparatus which include a cleaning member for removing a residual development agent 1 on an electrophotographic photosensitive member after a development agent image is transferred from the electrophotographic photosensitive member to a recording medium.

BACKGROUND ART

An electrophotographic image forming apparatus forms a latent image on an electrophotographic photosensitive member, then develops the latent image with a development agent (hereinafter, referred to as "toner") into a visible image and transfers the toner image to a recording medium through a transfer means to complete image formation. In such an electrophotographic image forming apparatus, a cleaning device removes extraneous matter, such as transfer-residual toner, from the electrophotographic photosensitive member, after the completion of transfer, in preparation for reuse of the electrophotographic photosensitive member.

FIG. 9 illustrates a photosensitive drum 100 and a cleaning device 600, after transfer processing by a transfer means. The photosensitive drum 100 moves in the direction of an arrow A, so that transfer-residual toner 001 left on the photosensitive drum 100, which has not been transferred during the transfer processing, reaches the cleaning device 600.

The cleaning device 600 includes a cleaning blade 601 having rubber elasticity, a toner housing portion 603 for housing extraneous matter, such as transfer-residual toner removed by the cleaning blade 601, and a sealing sheet 602 as a sealing member. The sealing sheet 602 contacts with the surface of the photosensitive drum 100 upstream of the cleaning blade 601 in the direction of the movement of the photosensitive drum, in such a manner as to allow the toner on the photosensitive drum 100 to pass therethrough in the direction of the movement of the photosensitive drum 100. The cleaning blade 601 removes the transfer-residual toner 003 that passes through a nip portion N between the sealing sheet 602 and the photosensitive drum 100, from the surface of the photosensitive drum 100. The sealing sheet 602 collects the removed toner 005 and causes it to be housed in the toner housing portion 603.

The aforementioned sealing sheet 602 is placed obliquely with respect to the photosensitive drum 100, such that the free end thereof is in contact with the outer peripheral surface of the photosensitive drum 100. Further, the sealing sheet 602 is placed, such that the gap between the photosensitive drum 100 and the sealing sheet 602 is gradually decreased in the direction of the rotation of the photosensitive drum 100.

As the aforementioned sealing sheet 602, a sealing sheet having elasticity is employed in order to prevent the occurrence of a gap at the nip portion N between the photosensitive drum 100 and the sealing sheet 602, and it is preferable to employ a sealing sheet 602 which can intimately contact the photosensitive drum 100. This is because a sealing sheet which can intimately contact the photosensitive drum can prevent the toner scraped off by the cleaning blade 601 from leaking to the outside of the toner housing portion 603 through the nip portion N between the photosensitive drum 100 and the sealing sheet 602.

There are sealing sheets made of thermoplastic urethane, which have been known as preferable sealing sheets (Patent Literature 1). It is preferable that the contact pressure between the sealing sheet and the photosensitive drum has a value which does not damage a photosensitive layer in the photosensitive drum and allows the toner on the photosensitive drum to pass through the nip portion N along with the movement of the photosensitive drum.

Patent Literature 1: Japanese Utility Model Application Publication No. 1-21323

DISCLOSURE OF THE INVENTION

An image forming apparatus employing a cleaning device as illustrated in FIG. 9 may be configured to perform charge elimination on the photosensitive drum 100, at a position downstream of the position where the transfer processing is performed, but upstream of the sealing sheet 602, in the direction of the movement of the photosensitive drum 100. This is because of the following reason. That is, by performing charge elimination on the photosensitive drum 100 before the transfer-residual toner 001 thereon enters the cleaning device 600, it is possible to reduce the electrostatic adhesion of the transfer-residual toner 001 to the photosensitive drum 100, which enables the cleaning device 600 to preferably remove the transfer-residual toner 001. However, in the case of employing the aforementioned configuration, if image formation operation is repeatedly performed for a long time period at a high temperature and in a high-humidity environment, this situation may cause the aforementioned sealing sheet 602, which is a sealing member, to intercept a portion of the transfer-residual toner 001. The intercepted toner may drop from the surface of the photosensitive drum 100, without being collected by the cleaning device 600.

The aforementioned phenomenon will be described with reference to FIG. 10. In general, along with the use of the electrophotographic image forming apparatus for a long time period, the transfer efficiency is reduced, due to the degradation of the charging performance of toner and the like. This increases the amount of transfer-residual toner 001 which has not been transferred from the photosensitive drum 100 and thus is left thereon. Namely, this increases the amount of transfer-residual toner 001 which reaches the nip portion N between the sealing sheet 602 and the photosensitive drum 100. Consequently, all the transfer-residual toner 001 can not pass through the nip portion N, due to the physical contact with the sealing sheet 602 and, thus, some transfer-residual toner 002 is intercepted before the nip portion N.

The transfer-residual toner 002 intercepted by the sealing sheet 602 is deposited upstream of the nip portion N at the portion of contact between the photosensitive drum 100 and the sealing sheet 602, due to its mirror image forces and Van der Waals forces. Further, when the sealing sheet 602 and the photosensitive drum 100 are opened downwardly in the direction of the gravity, as illustrated in FIG. 10, if a greater amount of toner is deposited, some toner 004 will drop therefrom due to gravity. The toner 004 may contaminate the inside of the image forming apparatus.

Therefore, it is an object of the present invention to provide a process cartridge and an image forming apparatus which can suppress the deposition of toner on a sealing member and can also suppress the dropping of deposited toner therefrom, at a high temperature and in a high humidity environment.

The aforementioned object can be attained with the following configuration.

This configuration relates to a process cartridge which can be detachably mounted in an image forming apparatus main body. The process cartridge includes a movable electrophotographic photosensitive member, a cleaning member, a sealing member, a frame, and a light passing portion. The cleaning member contacts the surface of the electrophotographic photosensitive member and removes a development agent from the surface of the electrophotographic photosensitive member. The sealing member contacts the surface of the electrophotographic photosensitive member upstream of the cleaning member in the direction of the movement of the electrophotographic photosensitive member and allows the development agent on the electrophotographic photosensitive member to pass therethrough in the direction of the movement of the electrophotographic photosensitive member, while preventing the removed development agent from leaking out. The frame includes the electrophotographic photosensitive member, the cleaning member, and the sealing member. The light passing portion is provided in the frame and is for passing, therethrough, charge elimination light for eliminating charge from the surface of the electrophotographic photosensitive member, at a position downstream of a transfer position but upstream of a portion where the electrophotographic photosensitive member contacts the sealing member, in the direction of the movement of the electrophotographic photosensitive member. The difference between a work function of the electrophotographic photosensitive member and a work function of the sealing member is equal to or greater than 0.25 [eV].

Further, there is provided another configuration as follows.

This configuration also relates to a process cartridge which can be detachably mounted in an image forming apparatus main body. In addition, in this configuration the process cartridge includes a movable electrophotographic photosensitive member, a cleaning member, and a sealing member. In this configuration, the process cartridge also includes a charge elimination device that eliminates charge from the surface of the electrophotographic photosensitive member, at a position downstream of a transfer position but upstream of a portion where the electrophotographic photosensitive member contacts the sealing member, in the direction of the movement of the electrophotographic photosensitive member. In addition, in this configuration the difference between a work function of the electrophotographic photosensitive member and a work function of the sealing member is equal to or greater than 0.25 [eV].

Further, there is provided further a different configuration as follows.

This configuration relates to an image forming apparatus including: a movable electrophotographic photosensitive member, a cleaning member, a housing, a sealing member, and a charge elimination member. The cleaning member contacts the surface of the electrophotographic photosensitive member and removes a development agent from the surface of the electrophotographic photosensitive member. The housing portion houses the development agent removed by the cleaning member. The sealing member contacts the surface of the electrophotographic photosensitive member upstream of the cleaning member in the direction of the movement of the electrophotographic photosensitive member and allows the development agent on the electrophotographic photosensitive member to pass therethrough in the direction of the movement of the electrophotographic photosensitive member, while preventing the removed development agent from leaking out. The charge elimination device eliminates charge from the surface of the electrophotographic photosensitive member, at a position downstream of a transfer position but upstream of a portion where the electrophotographic photosensitive member contacts the sealing member, in the direction of the movement of the electrophotographic photosensitive member. The difference between a work function of the electrophotographic photosensitive member and a work function of the sealing member is equal to or greater than 0.25 [eV].

According to the present invention, it is possible to suppress the deposition of development agent on the sealing member and suppress the dropping of deposited development agent therefrom, at a high temperature and in a high humidity environment.

BEST MODE FOR CARRYING OUT THE INVENTION

Hereinafter, with reference to the drawings, preferred embodiments of the present invention will be exemplarily described in detail. Here, the sizes, the materials, and the shapes of components described in the embodiments and the relative placement thereof should be varied as required, depending on the configuration of an apparatus to which the present invention is applied and on various types of conditions, and the scope of the present invention is not intended to be limited to the following embodiments.

Figure 1:
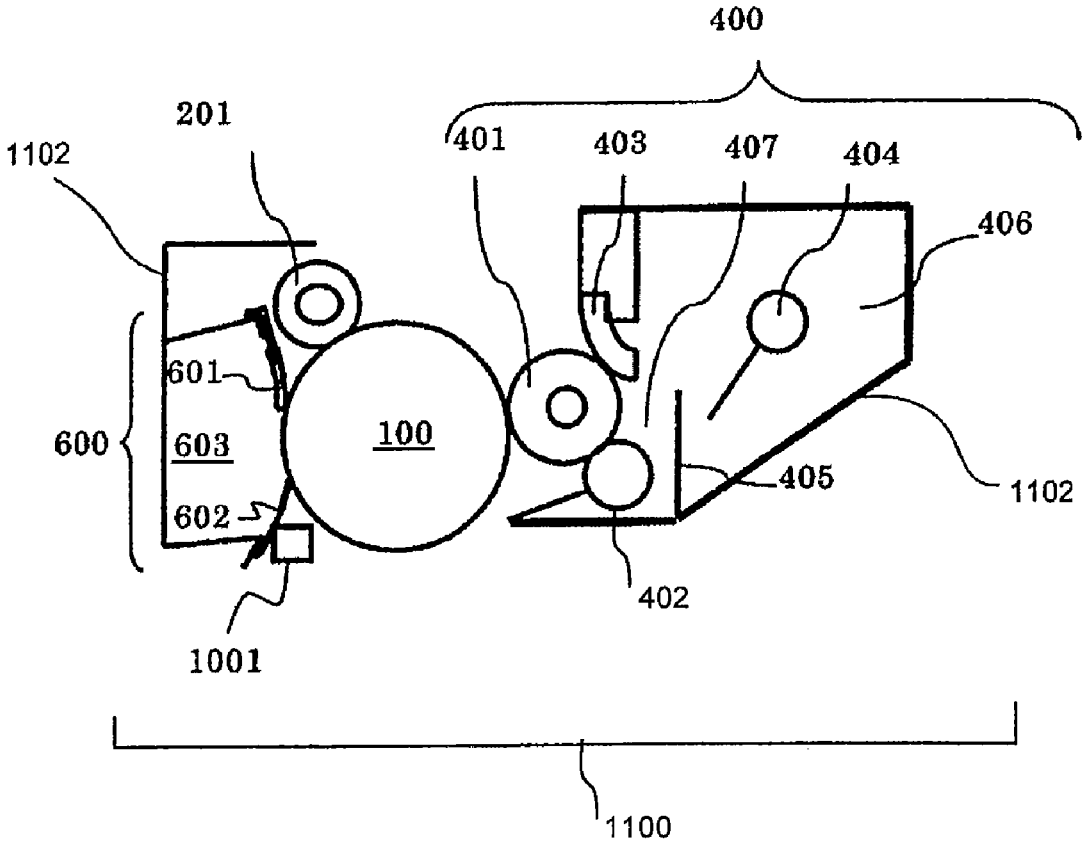
FIG. 1 is a schematic view of a process cartridge.
Figure 2:
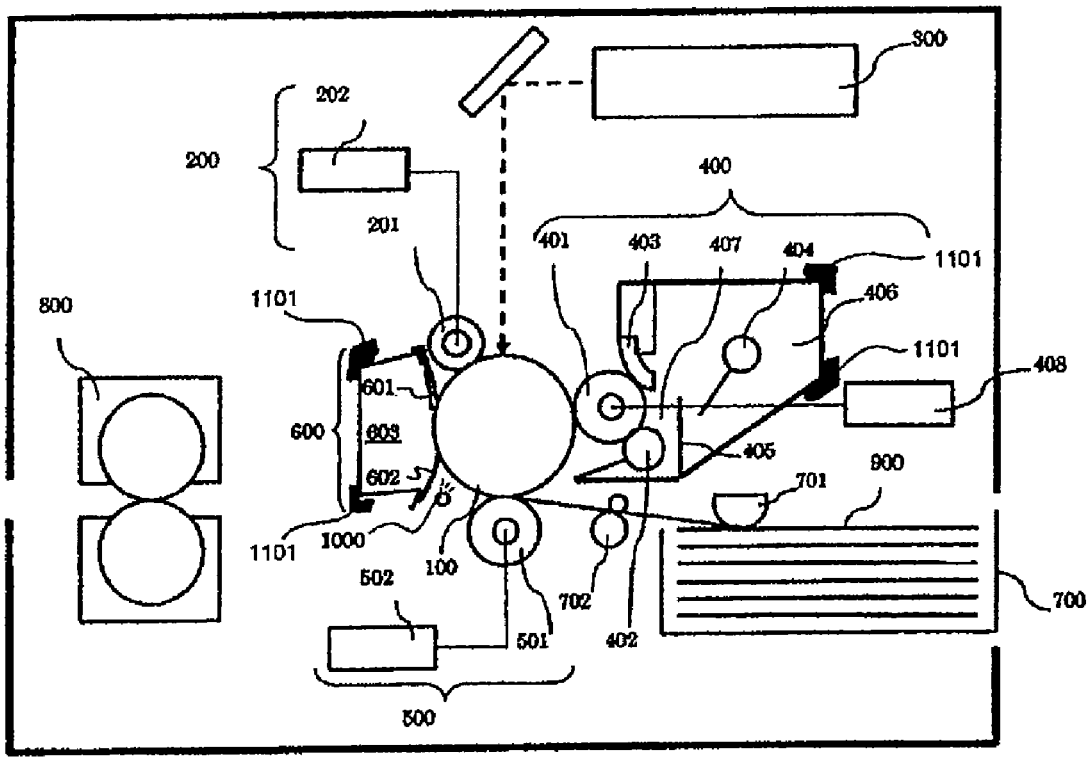
FIG. 2 is a schematic view of an image forming apparatus having the process cartridge.

Image Forming Apparatus:

FIG. 1 is a schematic explanation view of a process cartridge 1100 according to an embodiment of the present invention. FIG. 2 is an explanation view of an electrophotographic image forming apparatus which employs the aforementioned process cartridge 1100.

In the present embodiment, as illustrated in FIG. 1, a process cartridge 1100 is mounted to a mounting portion 1100 (see FIG. 2) provided in an image forming apparatus main body to constitute an electrophotographic image forming apparatus (hereinafter, referred to as "an image forming apparatus").

The process cartridge 1100 includes a photosensitive drum 100, a charging roller 201, a development device 400, and a cleaning device 600, which are provided in a frame 1102, in order to enable handling them integrally. The process cartridge 1100 further includes, at a portion of the frame 1102, an opening 1001 which is a light passing portion for directing, to the photosensitive drum 100, charge elimination light generated from an LED light source 1000 (see FIG. 2).

The image forming apparatus has a configuration as follows. At the center portion, there is placed the photosensitive drum 100 as an electrophotographic photosensitive member which enables forming an electrostatic latent image thereon. There are placed various types of processing means around the photosensitive drum 100. Namely, there are placed a charging device 200, which is a charging means for uniformly discharging/charging the photosensitive drum 100 with a negative polarity; an exposure device 300 for forming, through laser exposure, an electrostatic latent image corresponding to print information and image information, on the photosensitive drum 100 which has been charged; the development device 400 which is a development means for performing reversal development on the formed electrostatic latent image with toner being charged with a negative polarity for converting it into a visible image; a transfer device 500 which is a transfer means for transferring the visible toner images to a recording medium 900 which is a to-be-transferred member; the cleaning device 600 for removing transfer-residual toner and the like on the photosensitive drum 100; the LED light source 1000, which is a charge elimination device for eliminating the charge on the photosensitive drum 100 after the transfer; and a fixing device 800 for permanently fixing the toner image on the recording medium 900 transferred thereto. Further, there is provided a cassette 700 which is a feeding device for feeding the recording medium 900.

In the present embodiment, the image forming apparatus main body includes the LED light source 1000 as a charge elimination device, and the process cartridge 1100 includes the opening 1001 as a light passing portion for passing, therethrough, the charge elimination light generated from the LED light source 1000. The opening 1001 is provided in the frame 1102 of the process cartridge 1100 which includes the cleaning member, a housing portion and the like. Further, a transfer opening provided at the transfer position in the process cartridge 1100 may be utilized as the aforementioned opening 1001 or a scheme for guiding light through a light guide may be utilized. While the process cartridge 1100 is configured to receive light directed from the outside in the present embodiment, the present invention is not limited thereto and the process cartridge 1100 may be configured to include an LED light source. Further, the image forming apparatus main body or the process cartridge 1100 may be provided with a brush charge elimination device or the like as another charge elimination device for performing charge elimination.

The charging device 200 includes the charging roller 201, supporting members (not illustrated), a spring member (not illustrated), and a charging bias power supply 202, as main components. The charging roller 201 according to the present embodiment is constituted by a conductive elastic layer made of urethane rubber or the like whose core has a thickness of about 3 mm and a higher resistance layer thereon which is made of urethane rubber with a thickness of several millimeters and carbon black dispersed therein. The supporting members are conductive and rotatably support the charging roller 201 at its opposite end portions. The spring member presses the charging roller 201 against the photosensitive drum 100 through these supporting members. The charging bias power supply 202 provided in the image forming apparatus main body applies a voltage to the charging roller 201 through the spring member and the supporting members.

The charging roller 201 is installed, such that it is kept in contact with the photosensitive drum 100 and is driven to rotate in conjunction with the rotation of the photosensitive drum 100. In the present embodiment, during image formation, a DC voltage of about −1000 V is applied to the charging roller 201 through the charging bias power supply 202 to charge the surface of the photosensitive drum 100 at a dark potential (VD) of −500 V.

After the photosensitive drum 100 is charged at its surface to the dark voltage by the charging device 200, the photosensitive drum 100 is subjected to light exposure corresponding to print information and image information and the like through the exposure device 300 to form an electrostatic latent image thereon. The potential at the portion subjected to the light exposure is changed to a light potential (VL) of −100 V.

The development device 400 is partitioned, through a partition portion 405, into a hopper portion 406 for storing toner and a development chamber 407. Further, an agitating device 404 is placed in the hopper portion 406 to supply toner to the development chamber 407. In the development chamber 407, there are placed a development roller 401, a supply roller 402, and a development-agent restriction blade 403.

In the present embodiment, the development roller 401 includes a two-layer configuration constituted by a base layer with a diameter of 16 mm made of silicon rubber and a coating made of acrylic urethane rubber applied to the surface thereof and performs development on the electrostatic latent image on the photosensitive drum 100. Further, the supply roller 402 includes a urethane sponge with a diameter of 16 mm for supplying toner to the development roller 401. The development-agent restriction blade 403 made of metal restricts the thickness of the toner layer on the development roller 401.

The aforementioned agitating device 404, the development roller 401, and the supply roller 402 are configured to be driven from the outside and, during developing processing, they are kept rotating to supply toner to the photosensitive drum 100.

The developing roller 401 is installed, such that it is kept in contact with the photosensitive drum 100 for performing development. During image formation, a DC voltage of about −300 V is applied to the development roller 401 through a development bias power supply 408 so that the development roller 401 performs reversal development on the electrostatic latent image formed on the photosensitive drum 100 to convert the electrostatic latent image into a visible toner image.

The transfer device 500 according to the present embodiment includes a transfer roller 501 made of an EPDM sponge with a diameter of 12 mm, and a transfer bias power supply 502 for applying a voltage to the transfer roller 501. The voltage applied to the transfer roller 501 is controlled to a constant voltage during image formation. At the transfer position where the transfer roller 501 faces the photosensitive drum 100, the toner image on the photosensitive drum 100 is transferred to the recording medium 900.

The recording medium 900 housed within the cassette 700, which is a feeding device, is supplied to a registration roller 702 through a feeding roller 701, in synchronization with the formation of the visible image on the photosensitive drum 100. Then, the recording medium 900 is transferred, through the registration roller 702, to the portion between the transfer roller 501 and the photosensitive drum 100, in synchronization with the tip end of the visible image formed on the photosensitive drum 100. A DC voltage of about +2000 V is applied to the transfer roller 501 so that the toner image is transferred to the recording medium 900.

The toner image transferred to the recording medium 900 is transferred, along with the recording medium 900, to the fixing device 800. The fixing device 800 applies heat and pressure to the toner image to fix it into a recorded image.

On the other hand, the portion of the photosensitive drum 100 which has passed through the transfer device 500 is subjected to charge elimination processing through the charge elimination light from the LED light source 1000 so that the potential at the surface thereof is changed to about 0 V. The transfer-residual toner on the photosensitive drum 100 is passed through a sealing sheet 602 as a sealing member which lightly contacts the photosensitive drum 100. Thereafter, the transfer-residual toner is removed from the photosensitive drum 100 by a cleaning blade 601, which is a cleaning member made of polyurethane rubber. Then, the removed toner is housed in a waste toner housing portion 603. Thereafter, the surface of the photosensitive drum 100 is charged again by the charging device 200 in preparation for the next image formation operation.

Toner

Next, there will be described the toner used in the present embodiment. The image forming apparatus according to the present embodiment, employs as a developing agent, spherical toner with an average particle diameter of 6 mm and an average roundness of 0.970. The use of toner with an average roundness equal to or greater than 0.950 could significantly improve the fogging characteristic and the transferability and, therefore, was preferable.

Photosensitive Drum

Next, there will be described the photosensitive drums used in the present embodiment. In the present embodiment, two types of drums, which are a photosensitive drum A and a photosensitive drum B, are employed, wherein different resins are compounded in the charge transport layers formed on the surfaces of these drums. These drums have different work functions, since they contain different resins at their surfaces. Hereinafter, there will be described the methods for fabricating the respective photosensitive drums.

(1) Photosensitive Drum A

A conductive layer with a thickness of 15 μm was formed on an aluminum cylinder and, then, an under coating layer with a thickness of 0.7 mm was formed on the conductive layer. Then, a coating for a charge generating layer was applied on the under coating layer, through immersion coating, to form a charge generating layer.

Next, there will be described the material of the charge transport layer provided on the surface of the photosensitive drum 100. The charge transport material was formed as follows. That is, 7 parts of a compound defined as the following [Chemical Formula 1], a single part of a compound defined as the following [Chemical Formula 2], and 10 parts of a polyarylate resin (Mw=110000) with a constitutional unit defined as the following [Chemical Formula 3] were dissolved in a solvent made of mixture of 33 parts of dimethoxymethane and 60 parts of monochlorobenzene, wherein the aforementioned polyarylate resin was fabricated according to a method disclosed in JP-A No. 2000-227668.

[Chemical Formula 1]

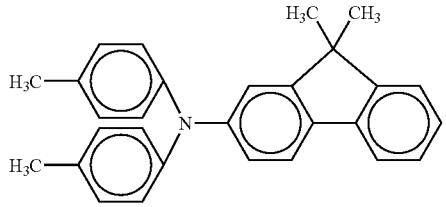

[Chemical Formula 2]

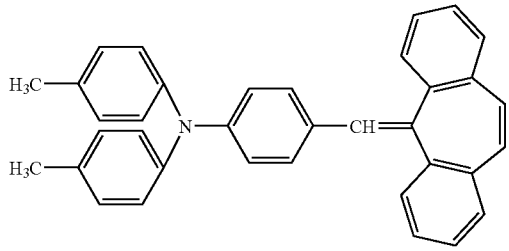

[Chemical Formula 3]

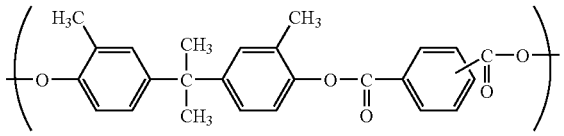

This coating was applied to the aforementioned charge generating layer through immersion coating and, then, was dried at 120° C. for 1 hour to form a charge transport layer with a thickness of 20 mm.

(2) Photosensitive Drum B

The photosensitive drum B was fabricated in the same way as the photosensitive drum A, except using a polyarylate resin with a constitutional unit defined by the following formula [Chemical Formula 4] (s/t=7/3, Mw=130000), instead of the polyarylate resin in the aforementioned photosensitive drum A.

[Chemical Formula 4]

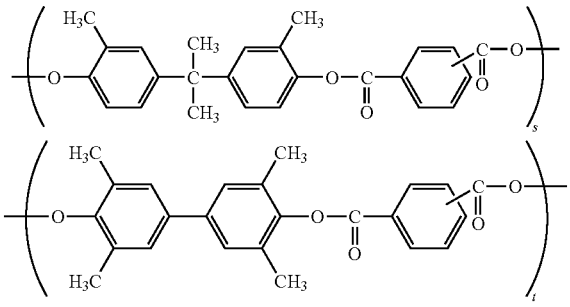

Next, there will be described the combination of the photosensitive drum 100 and the sealing sheet 602 as a sealing member, which is a key factor of the present invention. The present inventors have found, from the following experiments, that the absolute value of the difference between the work functions of the photosensitive drum 100 and the sealing sheet 602 (the determination method and other details will be described later) largely affects the collectability of transfer-residual toner. Hereinafter, the results of the experiments will be described in detail.

Experiment 1

The Toner Collectability in the Case of Using Various Types of Sealing Sheets

In the present embodiment, focusing attention on the material of the sealing sheet 602, at first, the collectability of transfer-residual toner at the nip portion N was evaluated, using sealing sheets 602 made of different types of materials.

The evaluations were conducted such that the calculated value of the contact pressure between the photosensitive drum 100 and each sealing sheet 602 per unit longitudinal length (the calculation method will be described later) fell in the range of $0.2156\times10^{-3}$ N/mm to $1.519\times10^{-3}$ N/mm.

If the aforementioned calculated value is smaller than $0.2156\times10^{-3}$ N/mm (0.22 gf/mm), this will increase the difficulty of uniformly bringing the sealing sheet 602 into contact with the photosensitive drum 100. If the aforementioned calculated value is greater than $1.519\times10^{-3}$ N/mm (0.155 gf/mm), this will cause the sealing sheet 602 to physically scrape off transfer-residual toner. This may degrade the toner collectability regardless of the material of the sheet and therefore is unpreferable.

Further, since the sealing sheet 602 lightly contacts the photosensitive drum 100, it was difficult to actually determine the contact pressure therebetween. Accordingly, the contact pressure was approximated to a calculated value.

The Method for Calculating the Contact Pressure Value

Hereinafter, with reference to FIG. 3, there will be described the method for calculating the contact pressure value between the photosensitive drum 100 and the sealing sheet 602.

Figure 3:
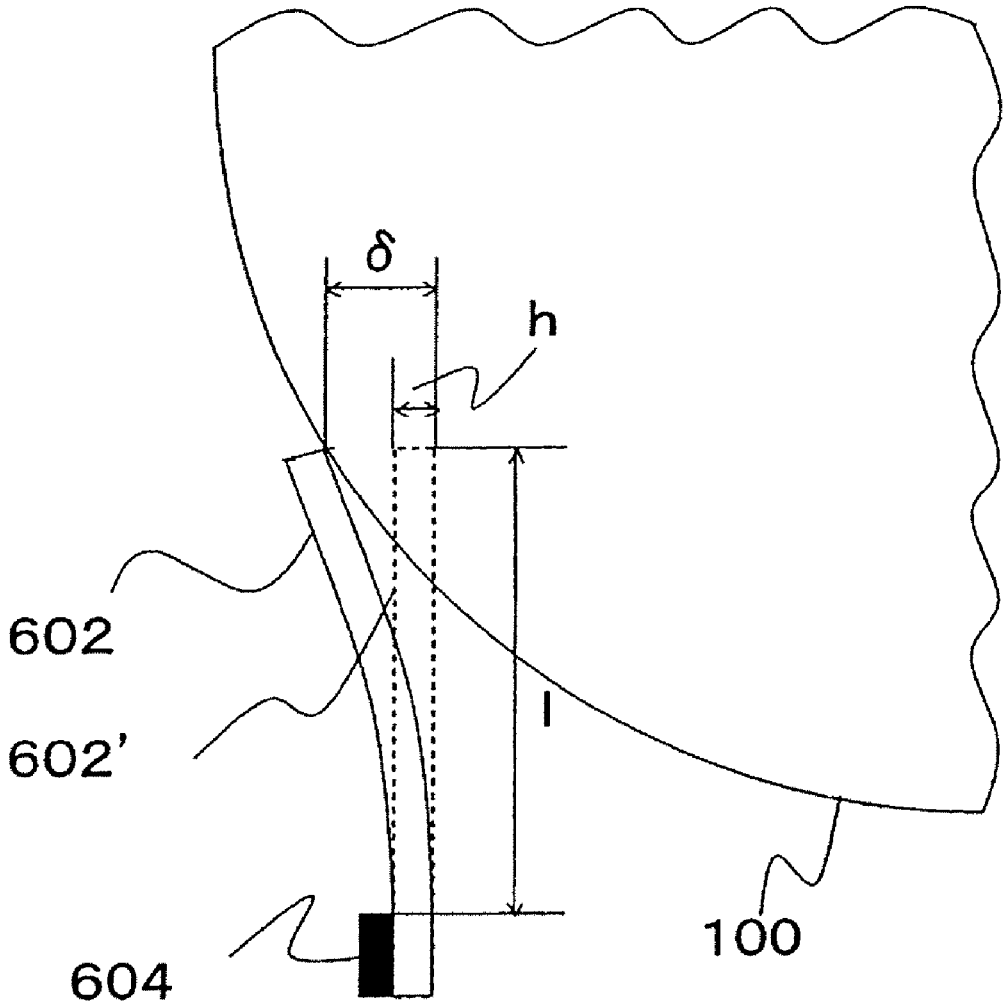
FIG. 3 is an explanation view of a calculated value of a contact pressure between an electrophotographic photosensitive member and a sealing sheet.

In FIG. 3, the sealing sheet 602, which adheres and is secured to an insulating bearing surface 604, is in contact with the photosensitive drum 100 at its tip end and is deflected thereby. The calculated value of the contact pressure P(N) between the sealing sheet 602 having a significantly small thickness than that used in an image forming apparatus and the photosensitive drum 100 per unit longitudinal length (1 mm) can be calculated from the following equation (A) using a general formula defining the relationship between the force acting on a cantilever spring and the deflection thereof.

In this formula, it is assumed that the amount of deflection of the sealing sheet 602 is δ mm, the distance from the fixed end of the sealing sheet 602 to the upstream side of the nip portion at the contact portion between the sealing sheet 602 and the electrophotographic photosensitive member 100 is 1 mm, and the thickness of the sealing sheet 602 is h mm.

$$P=\delta Eh^3/\{4l^3(1-\nu^2)\} \quad \text{(A)}$$

Further, E is the Young's modulus of the sealing sheet 602 ($N/mm^2$), and ν is the Poisson's ratio of the sealing sheet 602.

In the present experiment, the sealing sheet 602 was in contact with the photosensitive drum 100 substantially at its tip end. Accordingly, the distance l from the fixed end of the sealing sheet 602 to the upstream side of the nip portion at the contact portion between the sealing sheet 602 and the photosensitive drum 100 was approximated to the distance from the fixed end of a sealing sheet 602' to the free end thereof. Further, it was difficult to directly determine the amount of deflection of the sealing sheet 602. Accordingly, the amount of deflection of the sealing sheet 602 was determined through a geometrical calculation, on the basis of the thickness of the sealing sheet 602, the position of the bearing surface, and the position at which the sealing sheet 602 and the photosensitive drum 100 contact each other.

In the present experiment, the following 6 types of sheet materials were employed as the sealing sheets 602.

(1) Sealing Sheet A: A sheet formed from a PET sheet and Al formed thereon through vapor deposition (Metalumy (registered trademark), manufactured by Toray Advanced Film Co., Ltd.)

(2) Sealing Sheet B: A PET sheet (Lumirror (registered trademark), manufactured by Toray Corporation)

(3) Sealing Sheet C: A polyimide sheet (Upilex (registered trademark), manufactured by Ube Industries, Ltd.)

(4) Sealing Sheet D: A polyimide sheet (Kapton (registered trademark), manufactured by Du Pont-Toray Co., Ltd.)

(5) Sealing Sheet E: A PPS (Polyphenylene Sulfide) sheet (Torelina (registered trademark), manufactured by Toray Corporation)

(6) Sealing Sheet F: A sheet formed from a PET sheet and a Teflon (registered trademark) sheet adhere to the surface thereof (formed from the sealing sheet B and Nitofron (registered trademark) manufactured by Nitto Denko Corporation adhered to the surface thereof)

In the present experiment, the sealing sheets 602 formed from the aforementioned 6 types of sheet members and the aforementioned photosensitive drum A or the aforementioned photosensitive drum B were employed to form an image forming apparatus as described in FIG. 2.

Further, the sealing sheet A was brought into contact with the photosensitive drum 100 at its surface having Al vapor-deposited thereon. Further, the sealing sheet F was brought into contact with the photosensitive drum 100 at its surface having the Teflon sheet (registered trademark) adhered thereon. The sealing sheet A was usually conductive, but it was adhered to the insulating bearing surface 604 and is not electrically connected to the other members. At a higher temperature and in a higher humidity environment (30° C. and 80%), image formation was performed on 2000 paper sheets with a printing ratio of 8% (characters were output onto the entire surfaces of A4-size paper sheets with a printing ratio of 8%) and, then, the tendency of deposition of the transfer-residual toner was evaluated. Table. 1 illustrates the result along with the calculated values of the contact pressures of the sealing sheets 602.

Further, the collectability of transfer-residual toner was evaluated as the following four levels on the basis of the amount of toner deposited upstream of the nip portion at the contact between the sealing sheet 602 and the photosensitive drum 100.

1: There is no toner deposited thereon.

2: There is a small amount of toner deposited thereon.

3: There is toner deposited thereon and, further, a small amount of toner has dropped in the direction of gravity.

4. There is a greater amount of toner deposited thereon and, further, a greater amount of toner has dropped in the direction of gravity.

TABLE 1

| The relationship between "the combination of the photosensitive drum and the sealing sheet" and the tendency of deposition of transfer-residual toner | | | | |
|---|---|---|---|---|
| | PHOTOSENSITIVE DRUM A | | PHOTOSENSITIVE DRUM B | |
| SEALING SHEET MATERIAL | TONER DEPOSITION TENDENCY | CONTACT PRESSURE CALCULATED VALUE (N/mm) | TONER DEPOSITION TENDENCY | CONTACT PRESSURE CALCULATED VALUE (N/mm) |
| SEALING SHEET A | 1 | $0.4802 \times 10^{-3}$<br>$1.1466 \times 10^{-3}$ | 1 | $0.4802 \times 10^{-3}$ |
| SEALING SHEET B | 4 | $0.4998 \times 10^{-3}$<br>$1.1466 \times 10^{-3}$ | 3 | $0.2156 \times 10^{-3}$ |
| SEALING SHEET C | 4 | $0.3234 \times 10^{-3}$ | — | — |
| SEALING SHEET D | 3 | $0.9702 \times 10^{-3}$ | 4 | $0.4166 \times 10^{-3}$ |
| SEALING SHEET E | 2 | $0.4998 \times 10^{-3}$<br>$1.519 \times 10^{-3}$ | 4 | $0.2156 \times 10^{-3}$ |
| SEALING SHEET F | 1 | $0.4998 \times 10^{-3}$ | 1 | $0.2156 \times 10^{-3}$ |

The experiment using the photosensitive drum A was performed twice for the sealing sheets A, B, and E, under different conditions of the contact pressure. For this reason, two calculated values of the contact pressure are represented in Table. 1.

The results of the experiments revealed that the tendency of deposition of transfer-residual toner was varied depending on the combination of the photosensitive drum 100 and the sealing sheet 602. Further, it was assumed that the aforementioned evaluation levels 1 and 2 were in a preferable deposition-tendency range. Further, the same experiments were conducted on the image forming apparatus after image formation on 5000 paper sheets and 10000 paper sheets with a printing ratio of 8%, at a higher temperature and higher humidity environment (30° C. and 80%) and, thus, the tendency of deposition of the transfer-residual toner was evaluated. These experiments resulted in similar results.

Experiment 2

Determination of the Work Functions of Photosensitive Drums and Various Types of Sealing Sheets Here, in the present embodiment, focusing attention on the positional relationship between the photosensitive drum 100 and the sealing sheet 602 in the electrification rank, evaluations of the photosensitive drums A and B and the 6 types of sealing sheets A to F used in the experiments were conducted on the basis of their work functions determined according to the following determination method.

The work function (Φ) of a substance is the energy necessary for taking out electrons from the substance. If there is a larger work function difference between two members, frictional electrification caused between the two members will cause a greater electric field therebetween. If there is a smaller work function difference between two members, frictional electrification caused between the two members will cause a smaller electric field therebetween.

The Method for Determining the Work Function

The determination of the work function can be conducted according to the following determination method. The method can determine the work function as a numerical energy value [eV] required for taking out electrons from the substance and can also evaluate the charging polarities of the photosensitive drums and the sealing sheets.

The determination of the work functions (Φ) can be conducted using a surface analysis apparatus (AC-2, manufactured by Riken Keiki Co., Ltd.). In the present embodiment, in the aforementioned apparatus, a deuterium lamp was employed and the amount of irradiation light was properly set. Further, monochromatic light was selected through a spectrometer and the selected monochromatic light was directed to a sample with a spot size of 4 mm×4 mm, over an energy scanning range of 3.4 to 6.2 [eV], for a determination time period of 10 seconds/point. Further, photoelectrons emitted from the sample surface were detected, and the work function was determined through calculation processing using work-function calculation software incorporated in the surface analysis apparatus. The determination of the work function was conducted with a repeat accuracy (standard deviation) of 0.02 [eV].

The determinations of the work functions of the photosensitive drums 100 and the sealing sheets 602 were conducted, using the photosensitive drums and the sealing sheets which had been used for image formation on 2000 paper sheets with a printing ratio of 8% (outputting characters onto the entire surfaces of A4-size paper sheets with a printing ratio of 8%) at a high temperature and in a high humidity environment (at a temperature of 30° C. and a humidity of 80%). This was because the use of the image forming apparatus for a long time period at a high temperature and in a high humidity environment would cause the sealing sheet 602 to intercept the transfer-residual toner and, therefore, the work function of the photosensitive drum 100 that had been used for a longer time period at a high temperature and in a high humidity environment was critical.

Further, in the present experiment, prior to conducting the determinations of the work functions of the photosensitive drums 100 or the sealing sheets 602, dust on the surface thereof were removed through air blowing.

Further, the same experiments for determining the work functions were conducted for the photosensitive drums and the sealing sheets which had been used for image formation on 5000 paper sheets and 10000 paper sheets with a printing ratio of 8% at a higher temperature and in a higher humidity environment (at a temperature of 30° C. and a humidity of 80%). Thus, the tendency of deposition of the transfer-residual toner was evaluated. These experiments resulted in work function values similar to those resulting after the image formation on 2000 paper sheets.

Further, in order to ensure the data repeatability, the photosensitive drums and the sealing sheets for use as the determination samples were placed for 24 hours under the condition of a usage temperature of 25° C. and a humidity of 55%, after the aforementioned image formation.

When the determination was performed on a sheet-shaped sample as a sealing sheet 602, the sample is irradiated with determination light with a spot of 4 mm×4 mm, as described above. Accordingly, such a sheet-shaped sample was cut into a test sample piece with a size of at least 1 cm×1 cm and, then, the resultant test sample piece was secured to a sample table for determination.

Figure 4:
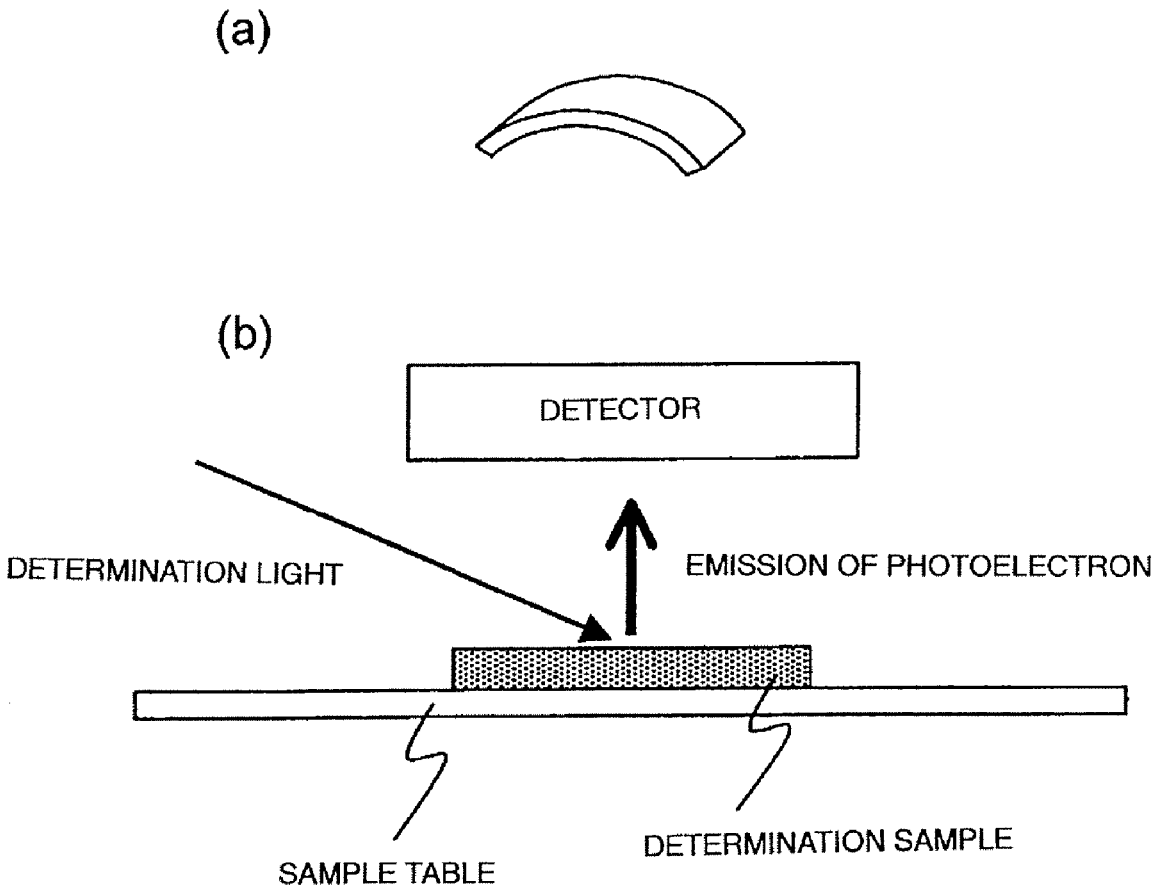
FIG. 4 (*a*) is a schematic view of a sample for determining a work function of a cylindrical shaped member in the image forming apparatus and FIG. 4(*b*) is a schematic view of a surface analysis apparatus.

Further, when a cylindrical shaped test sample, such as a photosensitive drum 100, was used as a sample, the cylindrical shaped test sample was cut into a determination test sample piece with a shape illustrated in FIG. 4(*a*). Then, as illustrated in FIG. 4(*b*), the determination test sample was secured to the sample table at a predetermined position thereon, such that the to-be-irradiated surface thereof was smooth in the direction of irradiation of the determination light. This enabled a detector (photomultiplier) to efficiently detect photoelectrons emitted therefrom.

When the excitation energy of the monochromatic light was scanned from a lower energy value to a higher energy value in the aforementioned surface analysis, the emission of photoelectrons started at an energy value [eV], and this energy threshold value was defined as the work function [eV].

Figure 5:
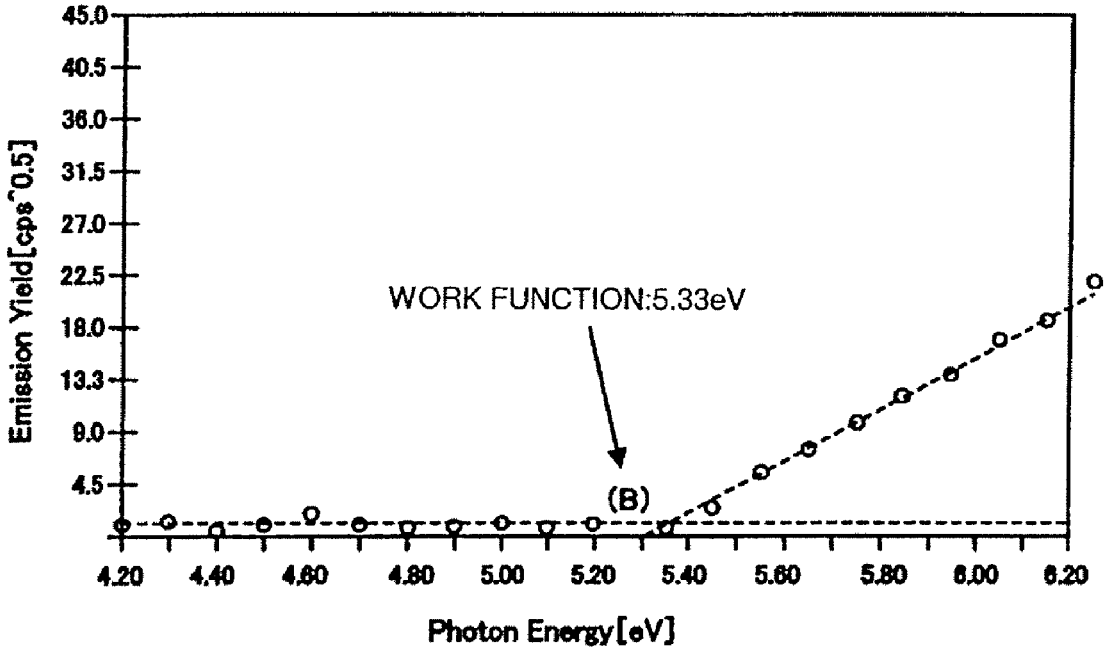
FIG. 5 is a chart of a work function of a sealing sheet determined using the surface analysis apparatus.

FIG. 5 illustrates an exemplary chart resulted from the use of the surface analysis apparatus for the sealing sheet B. In FIG. 5, circle marks indicate measurement values and broken lines are approximate lines connecting these circle marks to one another. In FIG. 5, the horizontal axis represents the photon energy [eV], while the vertical axis represents the emission yield [$cps^{0.5}$] (0.5 th power of the photoelectron yield per unit photoelectron), which offers a certain inclination (emission yield/photon energy). In FIG. 5, the work function is defined as the excitation energy value [eV] at the point where the broken line is bent (designated as (B) in FIG. 5). In FIG. 5, the excitation energy value is 5.33 [eV].

In the present experiment, the value of $|\alpha-\beta|$ was defined as the work function difference between the photosensitive drum and the sealing sheet, wherein $\alpha$ and $\beta$ were respectively the work functions of the sealing sheet and the photosensitive drum determined according to the aforementioned method.

Table. 2 illustrates the results of the determinations of the work functions of the photosensitive drum A and the sealing sheets A to F determined according to the aforementioned determination method, along with the result of the experiment 1 illustrated in Table. 1. Table 2 shows the tendency to improve the collectability of transfer-residual toner with an increasing difference between the work function of the photosensitive drum A, which is 5.45 [eV], and the work function of the sealing sheet A to F.

TABLE 2

The relationship between the work functions of the photosensitive drum a and various types of sealing sheets and the toner deposition tendency
THE WORK FUNCTION OF THE PHOTOSENSITIVE DRUM A AFTER PRINTING OF 2000 SHEETS = 5.45 eV

| | THE WORK FUNCTION OF SEALING SHEET [eV] | THE WORK FUNCTION DIFFERENCE BETWEEN THE PHOTOSENSITIVE DRUM A AND THE SEALING SHEET [eV] | TONER DEPOSITION TENDENCY | CONTACT-PRESSURE CALCULATED VALUE [N/mm] |
|---|---|---|---|---|
| SEALING SHEET A | 4.21 | 1.24 | 1 | $0.4802 \times 10^{-3}$<br>$1.1466 \times 10^{-3}$ |
| SEALING SHEET B | 5.33 | 0.12 | 4 | $0.4998 \times 10^{-3}$<br>$1.1466 \times 10^{-3}$ |
| SEALING SHEET C | 5.36 | 0.09 | 4 | $0.3234 \times 10^{-3}$ |
| SEALING SHEET D | 5.60 | 0.15 | 3 | $0.9702 \times 10^{-3}$ |
| SEALING SHEET E | 5.70 | 0.25 | 2 | $0.4998 \times 10^{-3}$<br>$1.519 \times 10^{-3}$ |
| SEALING SHEET F | 6.00 | 0.55 | 1 | $0.4998 \times 10^{-3}$ |

Next, Table 3 illustrates the results of the determinations of the work functions of the photosensitive drum B and the sealing sheets A, B, and D to F determined according to the aforementioned determination method, along with the result of the experiment 1 illustrated in Table. 1.

Table 3 shows the tendency to improve the collectability of transfer-residual toner with an increasing difference between the work function of the photosensitive drum B, which is 5.56 [eV], and the work functions of the sealing sheets A, B, and D to F.

TABLE 3

The relationship between the work functions of the photosensitive drum b and various types of sealing sheets and the toner deposition tendency
THE WORK FUNCTION OF THE PHOTOSENSITIVE DRUM B AFTER PRINTING OF 2000 SHEETS = 5.56 eV

| | THE WORK FUNCTION OF SEALING SHEET [eV] | THE WORK FUNCTION DIFFERENCE [eV] BETWEEN THE PHOTOSENSITIVE DRUM B AND THE SEALING SHEET | TONER DEPOSITION TENDENCY | CONTACT-PRESSURE CALCULATED VALUE [N/mm] |
|---|---|---|---|---|
| SEALING SHEET A | 4.21 | 1.35 | 1 | $0.4802 \times 10^{-3}$ |
| SEALING SHEET B | 5.33 | 0.23 | 3 | $0.2156 \times 10^{-3}$ |
| SEALING SHEET C | 5.60 | 0.04 | 4 | $0.4116 \times 10^{-3}$ |
| SEALING SHEET D | 5.70 | 0.14 | 4 | $0.2156 \times 10^{-3}$ |
| SEALING SHEET E | 6.00 | 0.44 | 1 | $0.2156 \times 10^{-3}$ |

Figure 6:
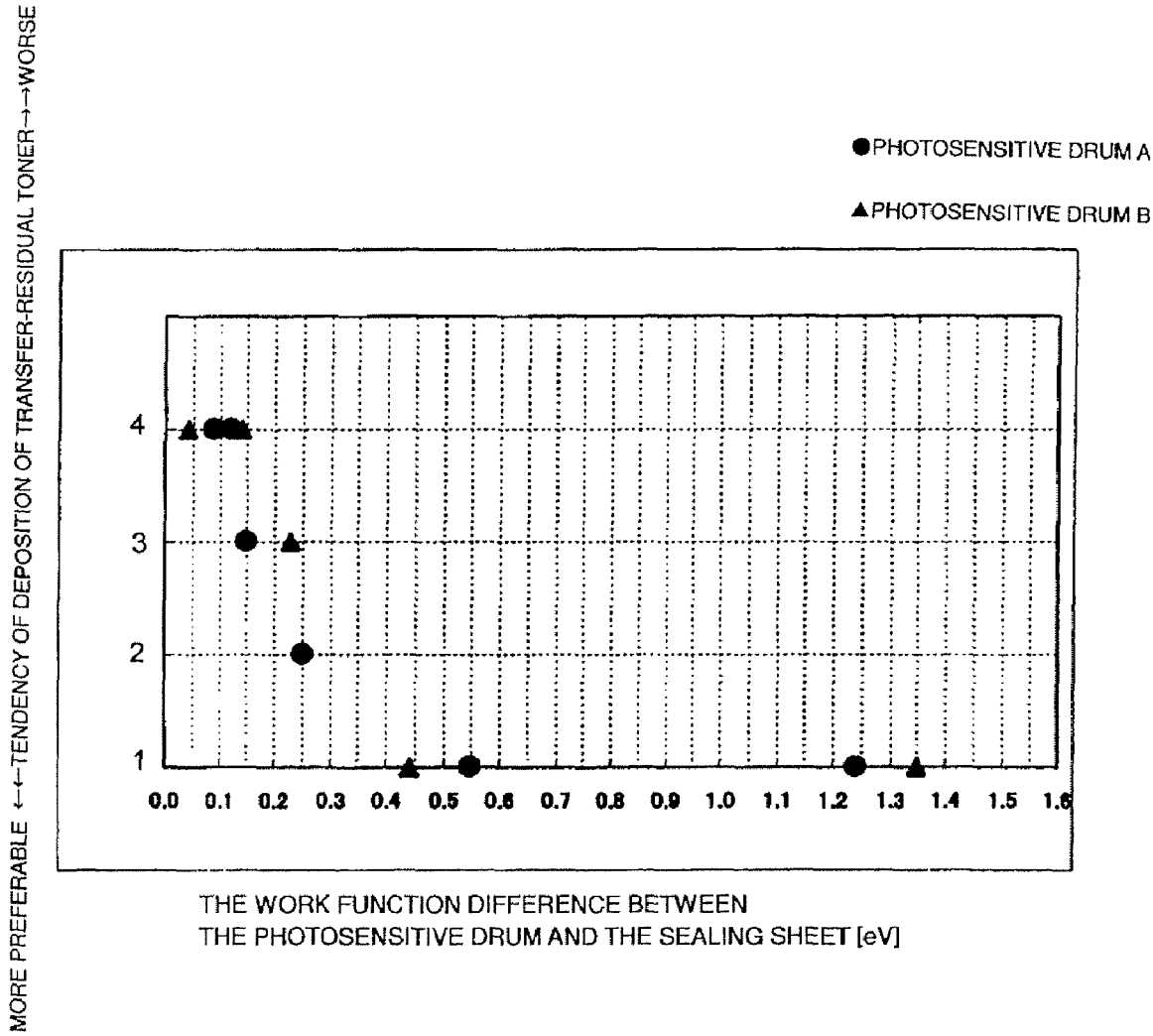
FIG. 6 is a graph illustrating a relationship between a collectability of transfer-residual toner and the work function difference between the electrophotographic photosensitive member and the sealing sheet.

FIG. 6 illustrates the relationship between the absolute value of the work function difference between the photosensitive drum 100 and the sealing sheet 602 and the collectability of transfer-residual toner, which was resulted from the experiment 2. In FIG. 6, the horizontal axis represents the work function difference [eV] between the photosensitive drum 100 and the sealing sheet 602, while the vertical axis represents the collectability of transfer-residual toner (the numerical values thereon indicate the aforementioned levels of the toner deposition tendency). In the figure, smaller values on the vertical axis indicate more preferable collectability.

FIG. 6 shows that there is a correlation between the collectability of transfer-residual toner and the work function difference between the photosensitive drum 100 and the sealing sheet 602. Namely, it shows that the collectability of transfer-residual toner is degraded as the work function difference between the photosensitive drum 100 and the sealing sheet 602 reaches 0 [eV], and the collectability becomes more preferable as the difference is increased. When it is assumed that the evaluation levels 1 and 2 of the toner deposition tendency are in a preferable range as previously described, if the work function difference between the photosensitive drum 100 and the sealing sheet 602 is equal to or greater than 0.25 [eV], preferable collectability can be realized without causing transfer-residual toner to be deposited upstream of the nip portion at the contact between the photosensitive drum 100 and the sealing sheet 602.

Figure 7:
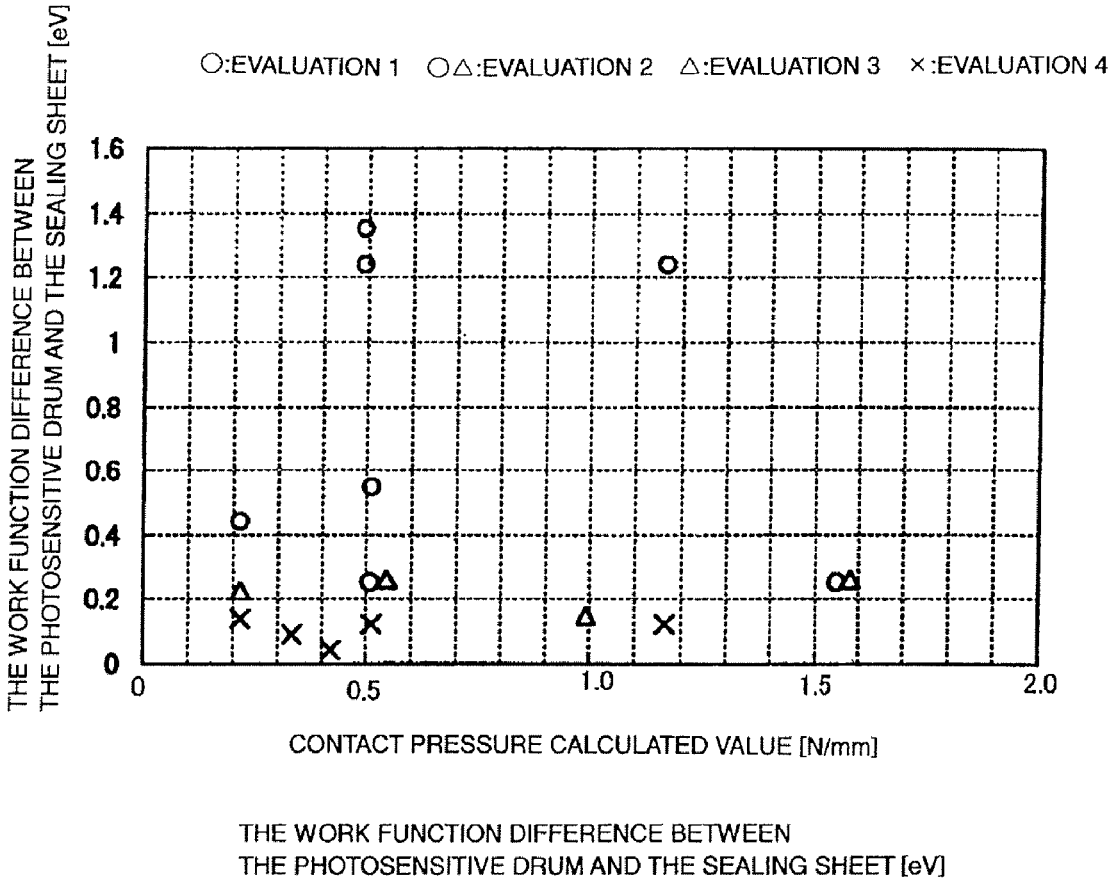
FIG. 7 is a graph illustrating a relationship between a collectability of transfer-residual toner and the contact pressure between the electrophotographic photosensitive member and the sealing sheet.

FIG. 7 is a graph of the plot of the result of the experiment 2, wherein the horizontal axis represents "the calculated value of the contact pressure between the photosensitive drum 100 and the sealing sheet 602", while the vertical axis represents "the work function difference between the photosensitive drum 100 and the sealing sheet 602". In FIG. 7, the shapes of plots "a circular shape", "a circular-triangular shape", "a triangular shape", and "a cross shape" indicate the aforementioned four levels of the toner deposition tendency, wherein "the circular shape", "the circular-triangular shape", "the triangular shape" and "the cross shape" indicate the aforementioned levels 1, 2, 3, and 4, respectively.

As can be seen from the result illustrated in FIG. 7, when "the calculated value of the contact pressure between the photosensitive drum 100 and the sealing sheet 602" was in the range of $0.2156\times10^{-3}$N/mm (0.22 gf/mm) to $1.519\times10^{-3}$ N/mm (0.155 gf/mm), the correlation between "the work function difference between the photosensitive drum 100 and the sealing sheet 602" and the collectability of transfer-residual toner was maintained.

The aforementioned facts reveal that, in a cleaning device including a cleaning member, which contacts with an electrophotographic photosensitive member for cleaning the surface of this electrophotographic photosensitive member, a housing portion for collecting extraneous matter removed by the cleaning member, and a sealing member, which contacts with the surface of the electrophotographic photosensitive member upstream of the cleaning member in the direction of the movement of the electrophotographic photosensitive member for sealing the aforementioned housing portion, if the sealing member is selected, such that the work function difference between the electrophotographic photosensitive member and the sealing member is equal to or greater than 0.25 [eV], it is possible to prevent transfer-residual toner from being deposited even at a high temperature and in a high-humidity environment, thereby suppressing the malfunctions of the collection of transfer-residual toner.

It is considered that the aforementioned effect is due to the following fact. That is, when there is a larger work function difference between the electrophotographic photosensitive member and the sealing member, the frictional electrification caused therebetween induces a greater electric field therebetween. Namely, when transfer-residual toner is collected in the waste toner housing portion through the sealing member, the transfer-residual toner is collected while being electrically held on any one of the electrophotographic photosensitive member and the sealing member, due to the electric field generated between the electrophotographic photosensitive member and the sealing member. Accordingly, when there is a greater work function difference between the electrophotographic photosensitive member and the sealing member, the malfunctions of the collection of transfer-residual toner can be suppressed. Therefore, it is preferable to employ a configuration capable of maintaining electric charges in the sealing member caused by the frictional electrification in order to offer the effects of the present invention.

In the present experiment, such a configuration capable of maintaining electric charges caused in the sealing member was realized by using a sealing member made of an insulation material (the sealing sheets B to F) or by using a conductive sealing member (the sealing sheet A) and an insulation bearing surface for adhering the sealing member thereon.

Further, the result of the present experiment reveals that, when the work function difference between the electrophotographic photosensitive member and the sealing member is equal to or greater than 0.25 [eV], the malfunctions of the collection can be suppressed, regardless of whether the value of $\alpha-\beta$ is positive or negative. Therefore, it is considered that the charging polarity and the work function of the developing agent have less influence on the collectability of transfer-residual toner.

Further, the same experiments were conducted for different rotation speeds of the electrophotographic photosensitive member and for different average particle sizes of the toner, and these experiments revealed that the change in the rotation speed of the electrophotographic photosensitive member and the change in the average particle size of the toner had no influence on the collectability of transfer-residual toner. Further, the experiments were conducted for several types of toner having different work functions, and these experiments revealed that the difference in the work function of the toner had no influence on the collectability of transfer-residual toner.

Further, the transfer-residual toner deposited upstream of the nip portion at the contact portion between the sealing sheet 602 and the photosensitive drum 100 will drop downwardly due to the gravity with time. Therefore, the present invention is effective, particularly when the photosensitive drum 100 and the sealing sheet 602 are opened downwardly in the direction of the gravity.

Figure 8:
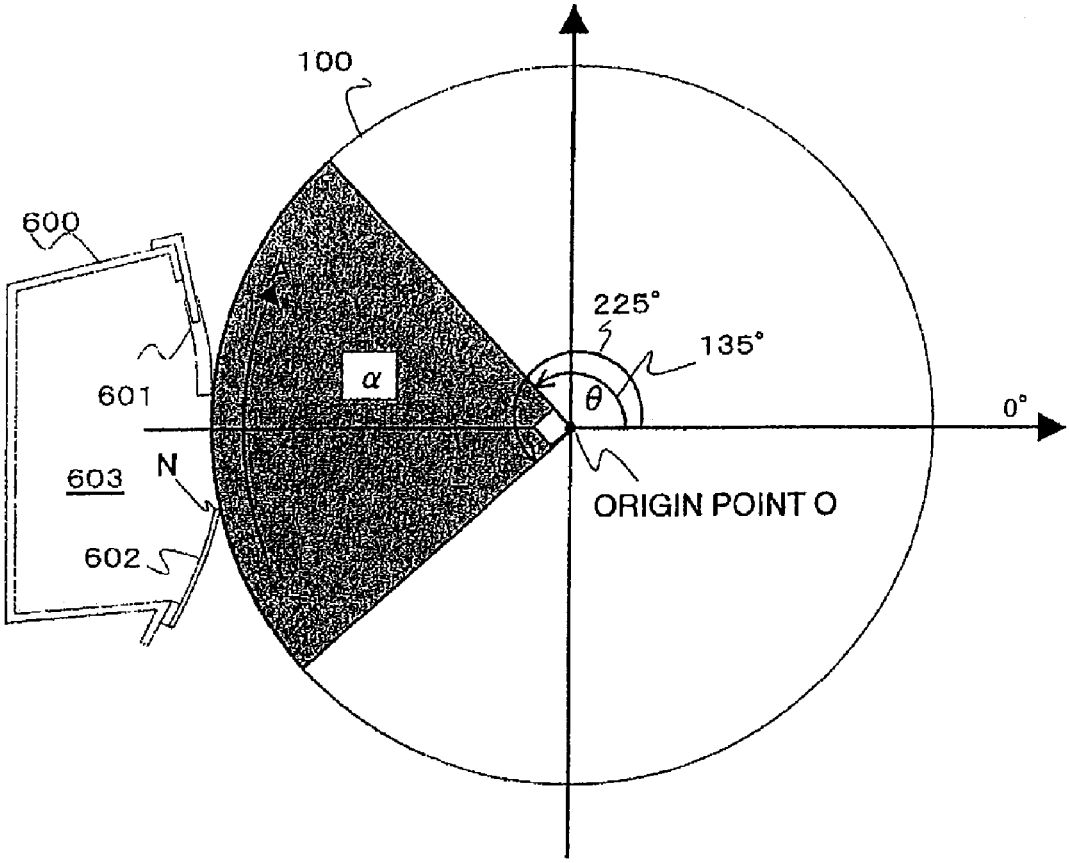
FIG. 8 is an explanation view of a position where the sealing sheet contacts with the electrophotographic photosensitive member.
Figure 9:
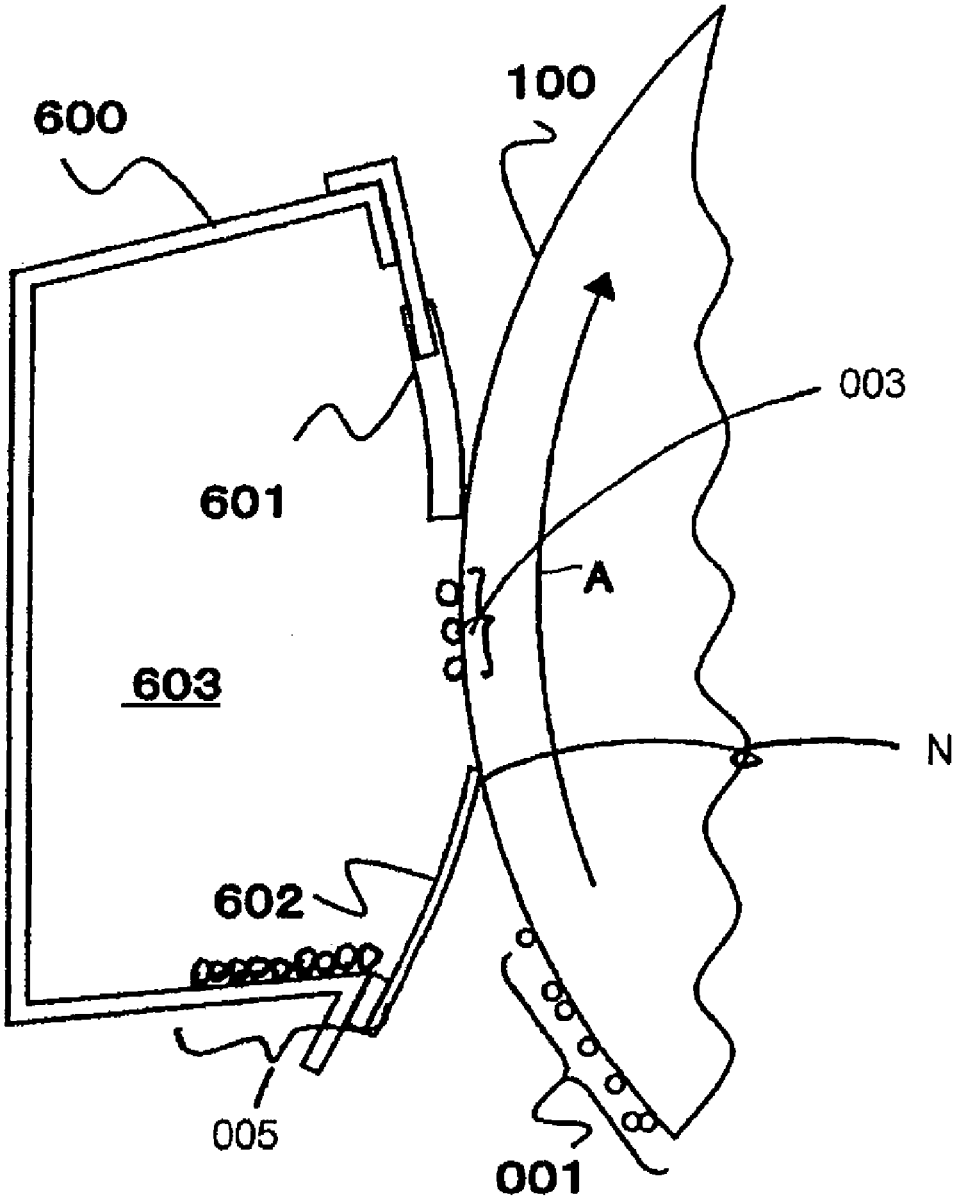
FIG.9 PRIOR ART
FIG. 9 is a schematic view of a cleaning device.
Figure 10:
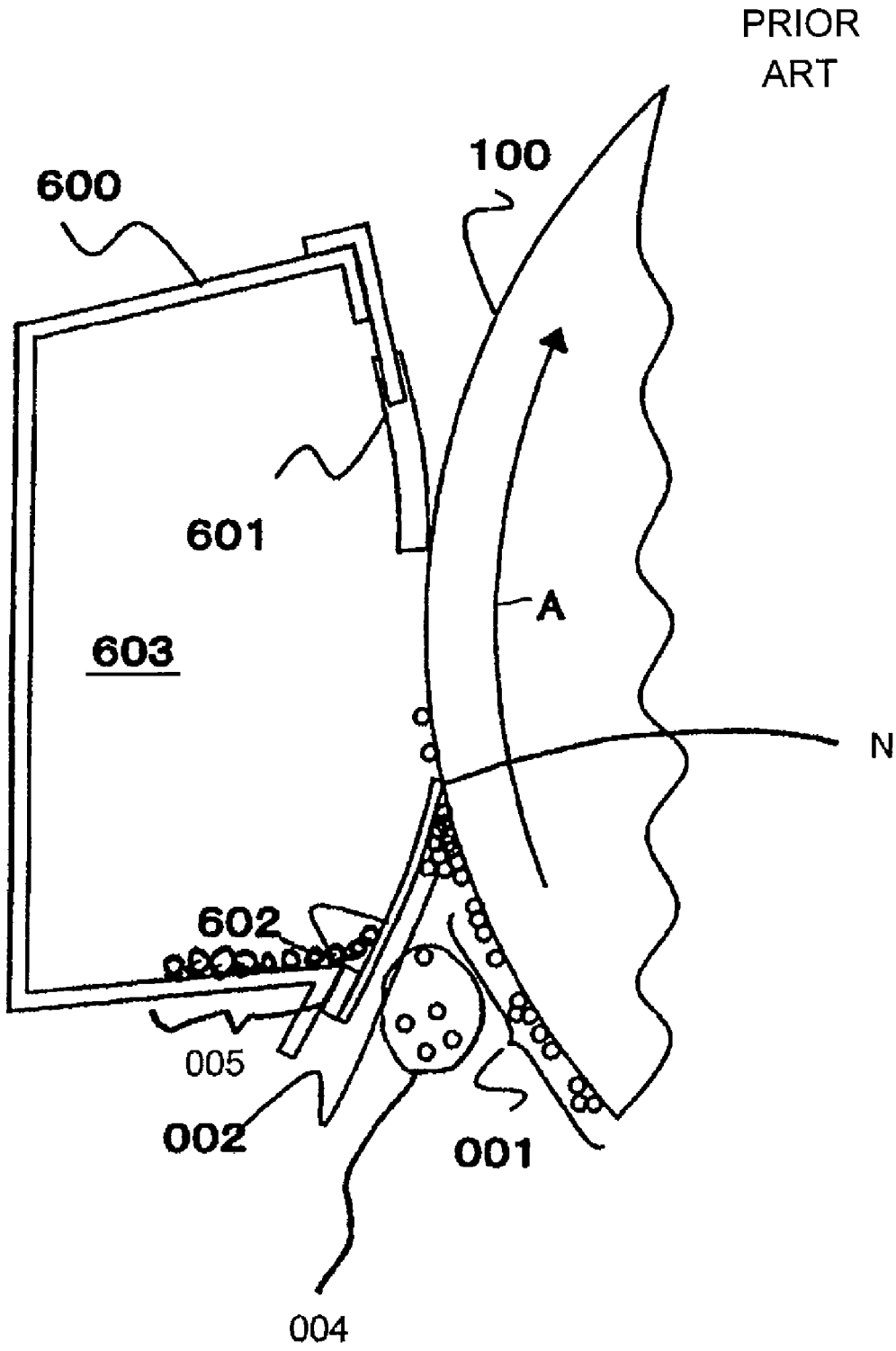
FIG. 10 is a schematic view of a malfunction of a collection of transfer-residual toner.

More specifically, the present invention is effective in the case where the nip portion N between the sealing sheet and the electrophotographic photosensitive member falls in an $\alpha$ region which is painted in FIG. 8, when the process cartridge is mounted in the image forming apparatus main body. Namely in the case where the nip portion falls in the range of a rotation angle $\theta$ of from 135° to 225°, wherein the rotation angle $\theta$ is the angle in the direction opposite to the direction A of the rotation of the photosensitive drum, when it is assumed that, in a two-dimensional coordinate system having an origin point at the center of the rotation of the photosensitive drum 100, the horizontal axis is at 0°. In the cleaning device 600 according to the present invention, the aforementioned rotation angle $\theta$ was 200°.

Further, while there has been described a case where the process cartridge is detachably mounted in the image forming apparatus main body in the present embodiment, the present invention is not limited thereto. The present invention is also effective when the cleaning device 600 is undetachably provided in the image forming apparatus main body.

Further, while there has been described a case where the process cartridge includes the charging roller 201, the development device 400, and the cleaning device 600 in the present embodiment, the present invention is also effective when the process cartridge includes at least a cleaning device.

Further, there has been described a case where there is provided the opening 1001 for passing, therethrough, charge elimination light emitted from the LED light source 1000 as a charge elimination device for eliminating charge from the surface of the photosensitive drum 100 or there is provided a charge elimination device other than an LED light source in the present embodiment. Also, the aforementioned charge elimination device can be configured to perform charge elimination using the exposure device for applying exposure to the surface of the photosensitive drum 100.

The present invention is applicable to image forming apparatus such as copiers, printers and the like and to process cartridges for use therein.

The invention claimed is:

1. A process cartridge which can be detachably mounted in an image forming apparatus main body, said process cartridge comprising:

a movable electrophotographic photosensitive member;

a cleaning member which contacts the surface of said electrophotographic photosensitive member and removes a development agent from the surface of said electrophotographic photosensitive member;

a housing portion that houses the development agent removed by said cleaning member;

a sealing member which contacts with the surface of said electrophotographic photosensitive member upstream of said cleaning member in the direction of the movement of said electrophotographic photosensitive member and allows the development agent on said electrophotographic photosensitive member to pass therethrough in the direction of the movement of said electrophotographic photosensitive member, while preventing the removed development agent from leaking out;

a frame which includes said electrophotographic photosensitive member, said cleaning member, said housing portion and said sealing member; and a light passing portion provided in said frame for passing, therethrough, charge elimination light for eliminating charge from the surface of said electrophotographic photosensitive member, at a position downstream of a transfer position but upstream of a portion where said electrophotographic photosensitive member contacts said sealing member, in the direction of the movement of said electrophotographic photosensitive member, wherein the difference between a work function of said electrophotographic photosensitive member and a work function of said sealing member is equal to or greater than 0.25 [eV].

2. The process cartridge according to claim 1 wherein a value calculated according to the following equation (A) falls in a range of $0.2156\times10^{-3}$[N/mm] to $1.519\times10^{-3}$ [N/mm], when $\delta$ is an amount of deflection of the sealing member, E is a Young's modulus of the sealing member, h is a thickness of the sealing member, 1 is a distance from a fixed end of the sealing member to an upstream side of a nip portion at a contact between the sealing member and the electrophotographic photosensitive member, and $\nu$ is a Poisson's ratio of the sealing member (Equation A)

$$\delta Eh^3/\{41^3(1-\nu^2)\} \quad \text{(A).}$$

3. The process cartridge according to claim 1, wherein said sealing member and said electrophotographic photosensitive member are opened downwardly in a direction of gravity from a position where they contact each other, at a state where said process cartridge is mounted in the image forming apparatus main body.

4. A process cartridge which can be detachably mounted in an image forming apparatus main body, said process cartridge comprising:

a movable electrophotographic photosensitive member;

a cleaning member which contacts with the surface of said electrophotographic photosensitive member and removes a development agent from the surface of said electrophotographic photosensitive member;

a housing portion that houses the development agent removed by said cleaning member;

a sealing member which contacts the surface of said electrophotographic photosensitive member upstream of said cleaning member in the direction of the movement of said electrophotographic photosensitive member and allows the development agent on said electrophotographic photosensitive member to pass therethrough in the direction of the movement of said electrophotographic photosensitive member, while preventing the removed development agent from leaking out; and a charge elimination device that eliminates charge from the surface of said electrophotographic photosensitive member, at a position downstream of a transfer position but upstream of a portion where said electrophotographic photosensitive member contacts said sealing member, in the direction of the movement of said electrophotographic photosensitive member;

wherein the difference between a work function of said electrophotographic photosensitive member and a work function of said sealing member is equal to or greater than 0.25 [eV].

5. The process cartridge according to claim 4, wherein a value calculated according to the following equation (A) falls in a range of $0.2156\times10^{-3}$[N/mm] to $1.519\times10^{-3}$ [N/mm], when δ is an amount of deflection of the sealing member, E is a Young's modulus of the sealing member, h is a thickness of the sealing member, 1 is a distance from a fixed end of the sealing member to an upstream side of a nip portion at a contact between the sealing member and the electrophotographic photosensitive member, and ν is a Poisson's ratio of the sealing member (Equation A)

$$\delta Eh^3/\{41^3(1-\nu^2)\} \quad \text{(A).}$$

6. The process cartridge according to claim 4, wherein said sealing member and said electrophotographic photosensitive member are opened downwardly in a direction of gravity from a position where they contact each other, at a state where said process cartridge is mounted in the image forming apparatus main body.

7. An image forming apparatus comprising:

a movable electrophotographic photosensitive member;

a cleaning member which contacts with the surface of said electrophotographic photosensitive member and removes a development agent from the surface of said electrophotographic photosensitive member;

a housing portion that houses the development agent removed by said cleaning member;

a sealing member which contacts with the surface of said electrophotographic photosensitive member upstream of said cleaning member in the direction of the movement of said electrophotographic photosensitive member and allows the development agent on said electrophotographic photosensitive member to pass therethrough in the direction of the movement of said electrophotographic photosensitive member, while preventing the removed development agent from leaking out; and a charge elimination device that eliminates charge from the surface of said electrophotographic photosensitive member, at a position downstream of a transfer position but upstream of a portion where said electrophotographic photosensitive member contacts said sealing member, in the direction of the movement of said electrophotographic photosensitive member;

wherein the difference between a work function of said electrophotographic photosensitive member and a work function of said sealing member is equal to or greater than 0.25 [eV].

8. The image forming apparatus according to claim 7, wherein a value calculated according to the following equation (A) falls in a range of $0.2156\times10^{-3}$ [N/mm] to $1.519\times10^{-3}$ [N/mm], when δ is an amount of deflection of the sealing member, E is a Young's modulus of the sealing member, h is a thickness of the sealing member, 1 is a distance from a fixed end of the sealing member to an upstream side of a nip portion at a contact between the sealing member and the electrophotographic photosensitive member, and ν is a Poisson's ratio of the sealing member (Equation A)

$$\delta Eh^3/\{41^3(1-\nu^2)\} \quad \text{(A).}$$

9. The image forming apparatus according to claim 7, wherein said charge elimination device directs light to the surface of said electrophotographic photosensitive member for eliminating charge therefrom.

10. The image forming apparatus according to claim 7, wherein said sealing member and said electrophotographic photosensitive member are opened downwardly in a direction of gravity from a position where they contact each other.

* * * * *